United States Patent [19]

Meckl et al.

[11] Patent Number: 5,004,676

[45] Date of Patent: Apr. 2, 1991

[54] PROCESS FOR THE PRODUCTION OF COLOR PHOTOGRAPHIC IMAGES COMPRISING REPLENISHING THE DEVELOPING SOLUTION

[75] Inventors: Heinz Meckl, Bergisch Gladbach; Sieghart Klötzer, Cologne; Erich Wolff, Solingen; Helmut Häseler, Leverkusen, all of Fed. Rep. of Germany

[73] Assignee: Agfa-Gevaert Aktiengessellschaft, Leverkusen, Fed. Rep. of Germany

[21] Appl. No.: 481,737

[22] Filed: Feb. 14, 1990

Related U.S. Application Data

[63] Continuation of Ser. No. 323,064, Mar. 10, 1989, abandoned, which is a continuation of Ser. No. 188,171, Apr. 26, 1988, abandoned, which is a continuation of Ser. No. 766,539, Aug. 19, 1985, abandoned.

[30] Foreign Application Priority Data

Aug. 30, 1984 [DE] Fed. Rep. of Germany ..... 3431860

[51] Int. Cl.[5] ..... G03C 5/24; G03C 7/00; G03C 7/30

[52] U.S. Cl. ..... 430/398; 430/399; 430/464; 430/467; 430/404; 430/567

[58] Field of Search ..... 430/374, 375, 399, 484, 430/467, 564, 567, 398

[56] References Cited

U.S. PATENT DOCUMENTS

| | | | |
|---|---|---|---|
| 2,193,015 | 3/1940 | Weissberger | 430/484 X |
| 2304,925 | 12/1942 | Jelley | 430/467 |
| 2,552,240 | 5/1951 | Weissberger | 430/484 X |
| 3,647,461 | 3/1972 | Surash et al. | 430/467 X |
| 3,647,462 | 3/1972 | Surash et al. | 430/467 |
| 3,814,606 | 6/1974 | Ozawa | 430/467 X |
| 4,186,007 | 1/1980 | Meckl et al. | 430/467 X |
| 4,297,437 | 10/1981 | Kaneko et al. | 430/399 |
| 4,298,681 | 11/1981 | Bulloch et al. | 430/484 |
| 4,590,155 | 5/1986 | Klotzer | 430/567 |

FOREIGN PATENT DOCUMENTS

| | | | |
|---|---|---|---|
| 0030332 | 3/1978 | Japan | 430/467 |

*Primary Examiner*—Paul R. Michl
*Assistant Examiner*—Patrick A. Doody
*Attorney, Agent, or Firm*—Connolly & Hutz

[57] ABSTRACT

A new process for maintaining the properties of the developer in the preparation of colored images by development of exposed silver halide-containing material at an alkaline pH in a developer bath containing p-phenylenediamine derivative and at least 40 mol-% of the silver halide consisting of silver chloride and replenishing the color developer in the bath in such a limited quantity that no overflow occurs but it is sufficient to make up for the loss of bath constituents.

This process preserves the sensitive results from development during use of the developer bath.

3 Claims, No Drawings

PROCESS FOR THE PRODUCTION OF COLOR PHOTOGRAPHIC IMAGES COMPRISING REPLENISHING THE DEVELOPING SOLUTION

This application is a continuation of application Ser. No. 07/323,064 filed Mar. 10, 1989, now abandoned, which is a continuation of application Ser. No. 188,171, filed Apr. 26, 1988, now abandoned, which is a continuation of application Ser. No. 766,539, filed Aug. 19, 1985, now abandoned.

The present invention relates to a process for the production of colour photographic images. During development, the colour developer is replenished to ensure that the properties of the developer are kept constant.

It is known that colour photographic images are to a large extent produced by the development of exposed silver halide recording materials. The composition of the developer bath changes in the course of development; for example, the concentration of the colour developer substances decreases while the concentration of halide in the bath increases due to diffusion from the developed material. The activity of the developer therefore changes unless countermeasures are taken. It is known from numerous publications, e.g. DE-A 2 007 459, 2 007 457 and 2 717 674, U.S. Pat. Nos. 3,647,461, 3,647,462 and 4,186,007 and EP-A 0 0 029 722, to replenish the developer bath with replacement substances to counteract such changes. These replacement substances are known as "replenishers". The substances used up in the course of development are maintained at the desired concentration by the addition of such replenishers. At the same time, in order to prevent unwanted accumulation of halide in the developer, a larger quantity of replenisher is added than the quantity lost from the developer bath. This procedure results in an overflow of a relatively halide-rich developer solution while the concentration of halide in the replenisher is kept low. In some cases, the replenisher is completely free from halide. The overflow is either discharged into the effluent or freed from halide, in particular bromide, e.o. by means of ion exchanger resins or dialysis apparatus and may be used again after the addition of regenerating chemicals.

In the first mentioned procedure, the effluent may become overloaded whereas the second procedure entails additional costs.

These disadvantages led to the development of so-called low replenishment replenisher solutions (LR replenishment) which keep the required substances at such a concentration that it has hitherto been possible to reduce the quantity of replenisher by as much as half the usual replenishment rate per $m^1$. By "replenishment rate" is meant the quantity of replenisher added per $m^2$ of developed recording material.

The disadvantage of this reduction in rate is that the bromide leaving the photographic layers accumulates to a correspondingly higher concentration, so that the developer solution must be maintained at a higher temperature. e.g. 38° C. to 40° C., in order to overcome the resulting inhibition in activity. Furthermore, the effluent is still charged by the overflow, even if to a less extent.

When attempts are made to reduce the quantity of overflow even further, the solubility limit of the developer substances in alkaline solution is approached. In addition, further increase in the bromide concentration necessitates a further raising of the temperature, which in turn progressively increases the effect of atmospheric oxygen and evaporation. One particularly disturbing factor is that the relatively high bromide concentration inhibits the activity of, for example, the frequently used developer substance, N-ethyl-N-(β-methyl-sulphonamidoethyl)-3-methyl-p-phenylene-diaminosesquisulphate-monohydrate (=CD 3). Even the increase in solubility which can be achieved by raising the pH to values above 12 is not sufficient, in combination with the increase in temperature, to achieve the desired development activity. Although an increase in activity can be achieved by the addition of more highly active developer substances, this measure entails further complications.

Another problem is the loss in volume due to evaporation which occurs especially during the periods when the development machine is not in operation. This loss in volume must be made up before operation is resumed by replenishing the developer solution in quantities which have been worked out empirically.

It is an object of the present invention to provide a process for the development of colour photographic recording materials which is not attended by these disadvantages.

A process for the production of colour photographic images has now been found, in which development of the exposed recording material containing silver halide is carried out in a developer bath which contains at least one p-phenylenediamine. According to the invention, the recording material used is one in which at least 40 mol-%, preferably at least 70 mol % of the silver halide consists of silver chloride, and the quantity of replenisher added to the developer bath during development is limited to such an amount that no overflow occurs.

The process according to the invention comprises at least one development step in which the exposed silver halide is reduced to silver, bleaching to oxidize the reduced silver, and fixing to remove the silver salts from the recording material. Bleaching and fixing may in some cases be combined in known manner.

Colour development is carried out in an aqueous developer bath. The temperature of the developer solution may be maintained at the usual level generally employed for conventional regeneration. and the silver chloride-rich material enables a much shorter development time to be employed.

Development may be carried out under the usual conditions for colour development. The pH at which development is carried out is generally above 8, preferably above 9.5. The concentration of the colour developer substances depends on the circumstances, but a concentration of about 4 to 40 mMol/l of developer solution ready for use is particularly preferred.

Development may be carried out in the presence of pH buffers. development inhibitors, anti-fogging agents, complex formers to soften water, preservatives, development accelerators, competing couplers, fogging agents, auxiliary developer compounds and viscosity modifying agents; see Research Disclosure 17 544 of December 1978, published by Industrial Opportunities Ltd., Homewell Havant, Hampshire, Great Britain, Section XXI, and Ullmanns Enzyklopädie der technischen Chemie, 4th Edition, Volume 18, 1979, in particular pages 451, 452 and 463 to 465. A detailed description of suitable developer compositions and methods of processing is given by Grant Haist, Modern Photographic Processing, John Wiley and Sons, 1973, Volumes 1 and 2.

The usual developer substances may be employed in the context of the present invention. These preferably contain p-phenylenediamine derivatives as colour developer substances, e.g. the following: N,N-Dimethyl-p-phenylenediamine, 4-amino-3-methyl-N-ethyl-N-methoxyethylaniline, 2-amino-5-diethylamino-toluene, N-butyl-N-α-sulphobutyl-p-phenylenediamine, 2-amino-5-(N-ethyl-N-β-methanesulphonamidoethylamino)-toluene, N-ethyl-N-β-hydroxyethyl-p-phenylenediamine, N,N-bis-(β-hydroxyethyl)-p-phenylenediamine, and 2.amino-5-(N-ethyl-N-β-hydroxyethylamino)-toluene. Other suitable colour developers have been described, for example, in J.Amer.-Chem.Soc. 73, 3100 (1951). Black/white developer substances may be used in addition.

According to a particularly preferred embodiment, the developer bath contains the following developer substance A

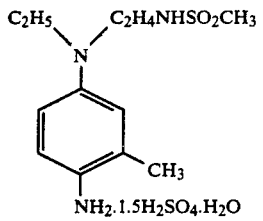

According to the invention, the developer bath is replenished with a replenisher. This is added at such a concentration and in such a quantity that no overflow occurs but it is sufficient to make up for the loss of bath constituents.

According to a preferred embodiment, the replenisher does not contain bromide. In this case, the proportion of silver bromide in the silver halide emulsions is chosen so that the bromide leaving the recording material maintains the bromide concentration in the developer solution constant at the desired level.

According to another preferred embodiment, the recording material consists of silver chloride emulsions to an extent of 100% and the replenisher contains the same bromide concentration as the developer solution.

The replenishment rate depends inter alia on the composition of the recording material and the constituents of the replenisher. According to a preferred embodiment, the replenisher used has a concentration of developer substance A of from 0.02 to 0.04 mol/1. Under these conditions a replenishment rate of about 80 to 100 ml/m$^2$ is particularly advantageous.

It has further been found that the loss in volume due to evaporation can easily be compensated automatically by setting the replenishment rate at a slightly lower level than the rate at which developer is carried out of the machine and making up the remaining loss in volume by adding water from a simple refilling device.

In one embodiment, the partial concentrates which are conventionally made up in liquid form for preparing the regenerator are added singly, directly to the developer solution in a volume calculated so that the total volume added is less than the volume lost. The short fall in volume is then made up by the addition of water from a water refilling device.

Development may be followed by bleaching and fixing in the usual manner, which may be carried out separately or in combination. The usual bleaching agents may be used, salts and complexes of trivalent iron as well as persulphates being particularly suitable. Suitable iron-III complexes include, for example, the complexes with amino-polycarboxylic acids, such as ethylene diaminotetracetic acid, nitrilotriacetic acid and 1,3-diamino-2-propanol-tetracetic acid, and hexacyanoferrates. Fixing may be carried out with the usual fixing baths containing a silver halide solvent as their main constituent. Thiosulphates are particularly preferred. The fixing baths may also contain sulphites, borates and other conventional additives.

The light-sensitive silver halide emulsion layers have colour couplers associated with them. These colour couplers react with colour developer oxidation products to form a non-diffusible dye. The colour couplers are advantageously incorporated in a non-diffusible form in the light-sensitive layer or closely adjacent thereto.

Thus the red-sensitive layer, for example, may contain a non-diffusible colour coupler to produce the cyan partial colour image, generally a coupler of the phenol or α-naphthol series. The green-sensitive layer may contain, for example, at least one non-diffusible colour coupler to produce the magenta partial colour image, conventionally a colour coupler of the 5-pyrazolone series. The blue sensitive layer may contain, for example, at least one non-diffusible colour coupler to produce the yellow partial colour image, generally a colour coupler having an open chain keto methylene group. The colour couplers may be, for example, 6-, 4- or 2-equivalent couplers. Suitable couplers have been disclosed, for example, in the publications, "Farbkuppler" by W. Pelz in "Mitteilungen aus den Forschungslaboratorien der Agfa, Leverkusen/München", Volume III. page 111 (1961): K. Venkataraman in "The Chemistry of Synthetic Dyes", Volume 4, 341 to 387, Academic Press, (1971): T. H. James, "The Theory of the Photographic Process", 4th Edition, pages 353 to 362, and the Journal, Research Disclosure No.17643, Section VII.

According to a particularly preferred embodiment, colour couplers which undergo sufficient coupling even without the usual addition of benzyl alcohol are used. Benzyl alcohol is conventionally used as phase transfer agent to enable coupling between oxidized colour developer and coupler to proceed at the desired velocity to form the image dyes. Benzyl alcohol is, however, a constant source of trouble in practical use, especially due to tar formation. Suitable couplers which may be used without benzyl alcohol are indicated in DE-A 3 209 710, DE-A 2 441 779, DE-A 2 640 601 and EP-A 0 067 689.

Particularly preferred yellow couplers have a structure corresponding to the following formulae:

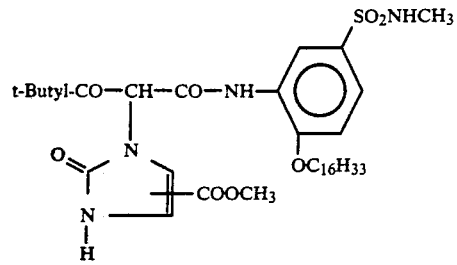
Y1
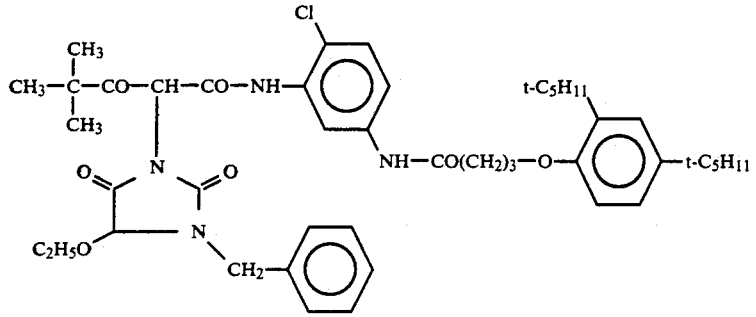
Y2
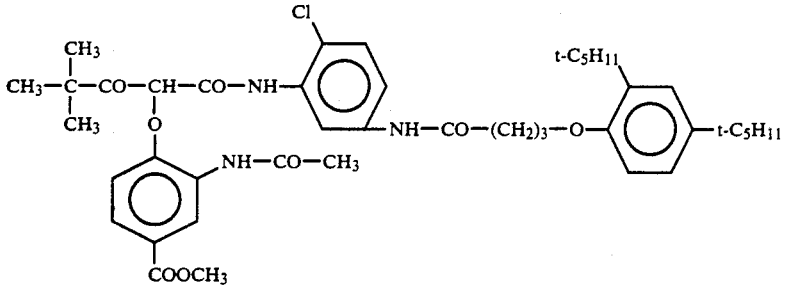
Y3
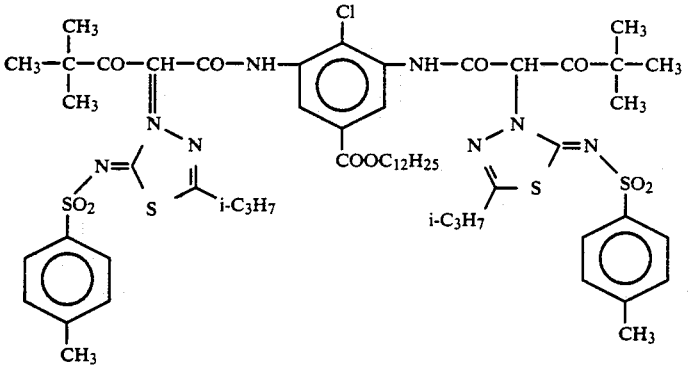
Y4
The following magenta couplers are particularly preferred:
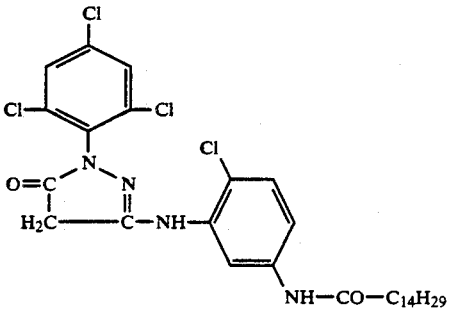
M1

-continued
M2
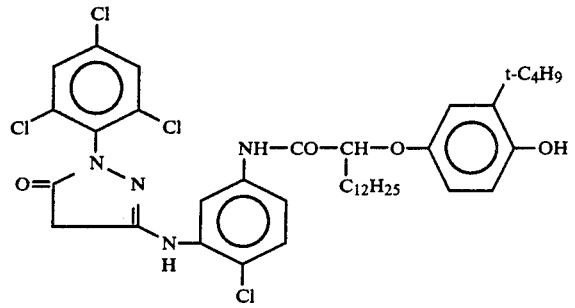
M3
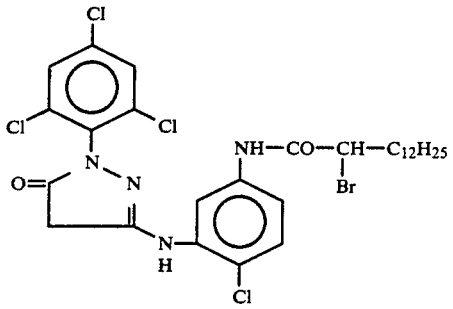
M4
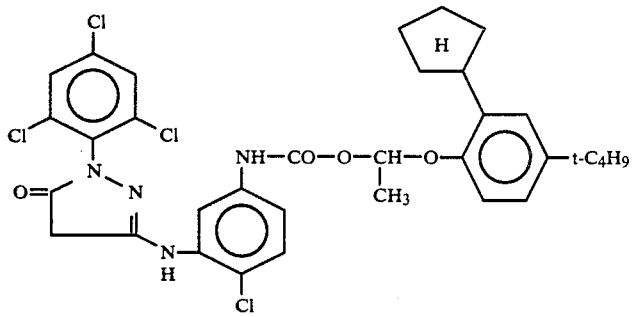
M5
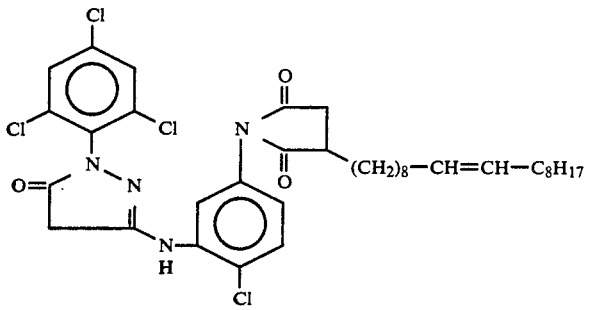
The following cyan couplers are particularly preferred:
C1
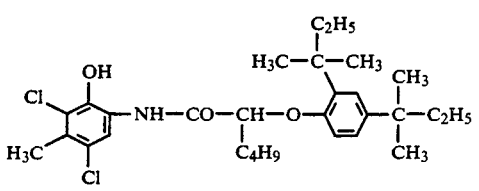
C2
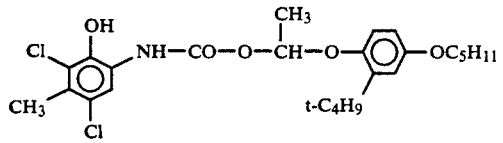
-continued
C3
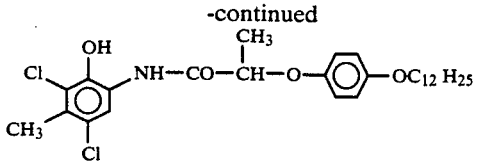

-continued

C4

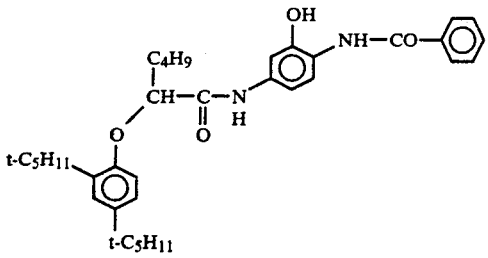

C5

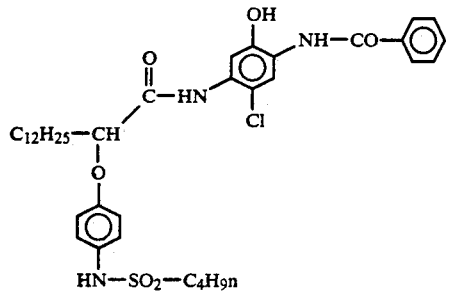

Further particularly preferred cyan couplers are phenols with an alkyl group in m-position to the OH-group, which alkyl group has at least 2 carbon atoms. Such couplers are described in Germany Offenlegungsschrift 33 40 270.

The recording material may also contain DIR compounds as well as so-called white couplers which do not give rise to a dye when they react with colour developer oxidation products. DIR compounds are understood to be compounds which react with colour developer oxidation products to release diffusible organic compounds which inhibit the development of silver halide. The inhibitors may be split off either directly or by way of non-inhibitory intermediate compounds. See GB 953 454, U.S. Pat. No. 3 632 345, U.S. Pat. No. 4 248 962 and GB 2 072 363.

The halides contained in the light-sensitive silver halide emulsions used may be chloride, bromide, iodide or mixtures thereof. According to a preferred embodiment, at least 90 mol-% of the halide content consists of AgCl. The silver halide grains may in principle have a layered grain structure consisting of a core and at least one shell.

In one embodiment, the grains have a layered grain structure comprising at least two regions which differ in their halide composition, e.g. a core and at least one sheath, at least one region B containing at least 10 mol-% of silver bromide, preferably at least 25 mol-% of silver bromide, but less than 50% of silver bromide.

The region B may be present both as the core and as sheath around a core. The grains preferably contain a core enveloped by at least one region B. In that case, the region B may exist as shell within the silver halide grain or on the surface of the crystal.

In another embodiment, the grains have at least one zone $Z_{Br}$ with a high bromide content, amounting to at least 50 mol-%. and no bromide-rich zone $Z_{Br}$ on the surface of the silver halide grains.

The silver bromide-rich zone $Z_{Br}$ in these grains may be present either as the core or as a layer within the silver halide grain. Preferably, 20 vol.-% of the silver halide of the grains are situated further from the crystal centre than the silver bromide-rich zone $Z_{Br}$.

The silver halide grains may in principle contain mixtures of chloride, bromide and iodide. The transition from one zone to an adjacent zone having a different composition may be sharp or gradual.

The silver halide emulsions may be prepared by the conventional methods (e.g. single inflow, double inflow, with constant or accelerated feed of material). The method of preparation by the double inflow process with control of the pAg value is particularly preferred: see Research Disclosure No. 17 643, Sections I and II.

The emulsions may be chemically sensitized. Compounds containing sulphur, such as allyl isothiocyanate, allyl thiourea or thiosulphates, are particularly preferred. Reducing agents may also be used as chemical sensitizers, e.g. the tin compounds described in Belgian Patents Nos. 493 464 and 568 687, and polyamines such as diethylenetriamine or aminomethylsulphinic acid derivatives, e.g. according to Belgian Patent No. 547 323. Noble metals and compounds of noble metals such as gold, platinum, palladium, iridium, ruthenium or rhodium are also suitable as chemical sensitizers. This method of chemical sensitiz ation has been described in the article by R. Koslovsky, Z.Wiss.Phot. 46, 65–72 (1951): see also the above mentioned Research Disclosure No. 17 643, Section III.

The emulsions may be optically sensitized in a known manner, e.g. with the usual polymethine dyes such as neutrocyanines. basic or acid carbocyanines, rhodacyanines, hemicyanines, styryl dyes. oxonoles and the like, see F. M. Hamer in "The Cyanine Dyes and related Compounds", (1964), Ullmanns Enzyklopädie der technischen Chemie, 4th Edition. Volume 18, pages 431 et seq, and the above mentioned Research Disclosure No. 17 643, Section IV.

The conventional anti-fogging agents and stabilizers may be used. Azaindenes are particularly suitable stabilizers, tetra- and penta-azaindenes being preferred, especially those which are substituted with hydroxyl or amino groups. Compounds of this kind have been indicated, for example, in the article by Birr, Z.Wiss.Phot. 47, 1952, pages 2–58, and in the above mentioned Research Disclosure No. 17 643, in Section IV.

The components of the photographic material may be incorporated by the usual, known methods: see, for example, U.S. Pat. Nos. 2,322,027, 2,533,514, 3,689,271, 3,764,336 and 3,765,897. Components of the photograhic material, e.g. couplers and UV absorbents, may also be incorporated in the form of charged latices, see DE-OS 2 541 274 and EP-A 14 921. The components may also be fixed in the material as polymers, see e.g. DE-OS 2 044 992, U.S. Pat. No. 3,370,952 and U.S. Pat. No. 4,080,211.

The usual layer supports may be used for the materials, e.g. supports of cellulose esters, e.g. cellulose acetate, and of polyesters. Paper supports are also suitable, and these may be coated, e.g. with polyolefins, in particular with polyethylene or polypropylene: see in this connection the above mentioned Research Disclosure No. 17 643, Section XVII.

The usual hydrophilic film forming agents may be used as protective colloids or binders for the layers of the recording material, e.g. proteins, in particular gelatine, alginic acid or its derivatives such as esters, amides or salts, cellulose derivatives such as carboxy-methylcellulose and cellulose sulphates, starches or their derivatives or hydrophilic synthetic binders: see also the binders indicated in the above mentioned Research Disclosure 17 643, in Section IX.

The layers of the photographic material may be hardened in the usual manner, for example with epoxide, heterocyclic ethyleneimine or acryloyl type hardeners. Furthermore, the layers may be hardened by the process according to German Offenlegungsschrift No. 2 218 009 to produce colour photographic materials suitable for high temperature processing. The photographic layers or colour photographic multilayered materials may also be hardened with hardeners of the diazine, triazine, or 1,2-dihydroquinoline series or with hardeners of the vinylsulphone type. Other suitable hardeners have been disclosed in German Offenlegungsschriften Nos. 2 439 551, 2 225 230 and 2 317 672 and in the above mentioned Research Disclosure 17 643, Section XI.

EXAMPLE 1

Preparation of emulsion, Emulsion A

A silver chloride emulsion is prepared within 25 minutes by pAg-controlled double inflow of a 0.3N NaCl solution and a 0.3N $AgNO_3$ solution to a 2.5% gelatine solution which has been heated to a temperature of 55° C. The average particle size is 0.15 μm and the emulsion has a monodisperse distribution. The crystals of this starting emulsion are increased in size to 36 times their volume by the further addition of 2N NaCl and 2N $AgNO_3$ solutions while the pAg is kept constant at 6.8.

An AgBr/AgCl shell is applied to the AgCl grains produced as described above by the simultaneous inflow of KBr/NaCl and $AgNO_3$ solutions, the KBr/NaCl solution containing 40 mol-% of bromide.

The crystals of the emulsion obtained have a monodisperse grain size distribution and an average particle diameter of 0.53 μm. The volumetric proportion of Br/Cl shell amounts to 10%, based on the total volume of the silver halide crystals. The AgBr content is 4 mol.%, based on the total halide.

Recording material

Using emulsion A, a recording material having the structure indicated in the following Table was prepared:

| Layer No. | Layer Description | Silver halide Emulsion | Silver halide Application (g $AgNO_3$) | Coupler | Further components |
|---|---|---|---|---|---|
| 1 | Substrate layer | — | — | — | |
| 2 | Blue-sensitive layer A | | | Y1 | |
| 3 | Intermediate layer | — | — | — | Oxform acceptor |
| 4 | Green-sensitive layer A | | | M1 | |
| 5 | Intermediate layer | — | — | — | UV absorbent layer + Oxform acceptor |
| 6 | Red-sensitive layer A | | | C1 | |
| 7 | Protective layer | — | — | — | |
| 8 | Hardening layer | — | — | — | 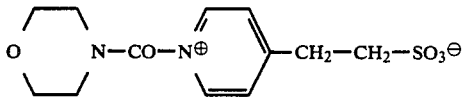 as hardener |

In addition to the substances indicated in the Table, the material contains the usual constituents of photographic recording materials, such as binders and oil formers.

Processing

The material was processed as follows:

| Bath | Temperature | Time (min) |
|---|---|---|
| Developer | 33° C. | 2 |
| Bleach fixing bath | 33° C. | 1.5 |
| Washing | 30° C. | 3.5 |

The developer has the following composition:

| Tank solution | |
|---|---|
| Water | 800 ml |
| Hydroxyl ammonium sulphate | 1.5 g |
| Diethylenetriaminopentacetic acid, pentasodium salt | 1.5 g |
| 4-Amino-N-ethyl-N-(β-methane-sulphonamide)-ethyl-m-toluidine-sesquisulphate (monohydrate) | 5.2 g |
| Potassium sulphite | 1.5 g |
| Potassium bromide | 0.7 g |
| Potassium carbonate | 25 g |
| Potassium hydroxide | 1.5 g |
| made up with water to 1 liter, pH = 10.2. | |

The developer was treated with the following replenisher solution used in a rate of 90 ml/$m^2$:

| Replenisher solution | |
|---|---|
| Water | 800 ml |
| Hydroxylammonium sulphate | 4 g |
| Diethylenetriaminepentacetic acid, pentasodium salt | 2 g |
| 4-Amino-N-ethyl-N-(β-methane-sulphonamido)-ethyl-m-toluidine-sesquisulphate (monohydrate) | 12 g |
| Potassium sulphite | 5 g |
| Potassium bromide | 0.7 g |
| Potassium carbonate | 25 g |
| Potassium hydroxide | 13 g |
| made up with water to 1 liter, pH = 12.3. | |

The bleach fixing bath had the following composition:

| Tank solution | |
|---|---|
| Water | 700 ml |
| Sodium sulphite | 20 g |
| Ammonium thiosulphate | 100 g |
| Sodium-iron salt of ethylenediaminotetracetic acid | 45 g |
| Potassium carbonate | 9 g |
| made up with water to 1 liter, pH = 7.0. | |

To prepare the bleach fixing bath replenisher, the liquid in the tank was only made up to 800 ml.

Comparison

For comparison, the same recording material is developed by a conventional development process, using conventional replenishers with overflow.

| Developer, Tank solution | |
|---|---|
| Water | 800 ml |
| Benzyl alcohol | 14 ml |
| Ethylene glycol | 7 ml |
| Hydroxylammonium sulphate | 3 g |
| Diethylene triaminopentacetic acid, pentasodium salt | 1.5 g |
| 4-Amino-N-ethyl-N-(β-methane-sulphonamide)-ethyl-m-toluidine-sesquisulphate (monohydrate) | 5.2 g |
| Potassium sulphite | 1.5 g |
| Potassium bromide | 0.7 g |
| Potassium carbonate | 33 g |
| Potassium hydroxide | 0.8 g |
| made up with water to 1 liter, pH = 10.2. | |

The developer was replenished with the following replenisher solution used in rate of 325 ml/m$^2$:

| Replenisher solution | |
|---|---|
| Water | 800 ml |
| Benzyl alcohol | 18 ml |
| Ethylene glycol | 9 ml |
| Hydroxylammonium sulphate | 4 g |
| Diethylenetriaminopentacetic acid, pentasodium salt | 2 g |
| 4-Amino-N-ethyl-N-(β-methane-sulphonamido)-ethyl-m-toluidine-sesquisulphate (monohydrate) | 6.5 g |
| Potassium sulphite | 2.5 g |
| Potassium bromide | 0.7 g |
| Potassium carbonate | 33 g |
| Potassium hydroxide | 1.8 g |
| made up with water to 1 liter, pH = 10.5. | |
| Bleach fixing bath as above. | |

Sensitometric assessment

A comparison between samples which have been developed immediately after preparation of the developer bath and those developed after the passage of 1000 m$^2$ of recording material through the bath shows no sensitometric differences. According to the invention, no overflow is used and no tar formation takes place in the developer whereas in the comparison experiment there is an unwanted overflow of 2400 l and troublesome tar formation.

EXAMPLE 2

The material described in Example 1 is subjected to the photographic process indicated in Example 1. The developer indicated in that Example is used.

Replenishment is carried out by the addition of individual concentrates and making up the volume with water.

| Individual concentrates | |
|---|---|
| Part A, | 1 liter |
| 700 ml | distilled water, |
| 360 g | hydroxylammonium sulphate |
| made up to 1 liter with distilled water | |
| Part B, | 1 liter |
| 600 ml | distilled water, |
| 216 g | 4-amino-N-ethyl-N-(β-methanesulphonamido)-ethyl-m-toluidine-sesquisulphate (monohydrate) |
| 40 g | sodium sulphite |
| 34 g | potassium hydroxide |
| made up with distilled water to 1 liter, pH = 3.5 | |
| Part C, | 1 liter |
| 800 ml | distilled water |
| 18 g | diethylenetriaminopentacetic acid, pentasodium salt |
| 20 g | potassium sulphite |
| 6.3 g | potassium bromide |
| 225 g | potassium carbonate |
| 117 g | potassium hydroxide |
| made up with distilled water to 1 liter. | |

The following quantities of parts A to C per m$^2$ of colour photographic paper passing through the developer tank are added to the developer tank from the appropriate number of metering pumps:
1 ml Part A, 5 ml Part B, 10 ml Part C.

The 74 ml required for completely replacing the volume of water removed with the paper are exactly replaced by means of a water refilling device.

The same advantageous results are obtained as in Example 1.

What is claimed is:

1. In a process for the production of color photographic images by development of an exposed silver halide recording material in a development bath of a predetermined volume containing a developing agent comprised of 4 to 40 mmol/l of at least one p-phenylenediamine derivative and/or its salt with an inorganic acid the improvement which comprises a silver halide recording material containing at least 90 mol-% of silver chloride, adding to said bath a replenisher containing 0.02 to 0.04 mol/l of said p-phenylenediamine derivative and water in an amount to maintain and not exceed said predetermined volume of said development bath.

2. Process according to claim 1, characterized in that no benzyl alcohol is contained in the development bath.

3. Process according to claim 2, characterized in that the bath contains the following p-phenylenediamine:

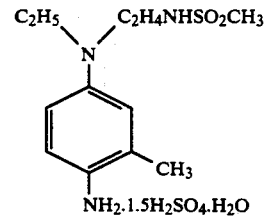

* * * * *